US011462869B2

(12) United States Patent
Stumme et al.

(10) Patent No.: US 11,462,869 B2
(45) Date of Patent: Oct. 4, 2022

(54) MODULAR SOLDERLESS CONNECTOR INTEGRATION FOR CONFORMAL PHASED ARRAYS

(71) Applicant: The Government of the United States of America, as represented by the Secretary of the Navy, Arlington, VA (US)

(72) Inventors: Anna Stumme, Washington, DC (US); William Mark Dorsey, Ellicott City, MD (US); John A. Valenzi, Alexandria, VA (US)

(73) Assignee: The Government of the United States of America, as represented by the Secretary of the Navy, Washington, DC (US)

( * ) Notice: Subject to any disclaimer, the term of this patent is extended or adjusted under 35 U.S.C. 154(b) by 220 days.

(21) Appl. No.: 16/864,719

(22) Filed: May 1, 2020

(65) Prior Publication Data

US 2020/0358233 A1 Nov. 12, 2020

Related U.S. Application Data

(60) Provisional application No. 62/845,008, filed on May 8, 2019.

(51) Int. Cl.

| | |
|---|---|
| ***H01Q 1/08*** | (2006.01) |
| ***H01R 24/52*** | (2011.01) |
| ***H01Q 1/48*** | (2006.01) |
| ***H01R 13/627*** | (2006.01) |
| ***H01Q 1/36*** | (2006.01) |
| ***H01Q 21/00*** | (2006.01) |

(52) U.S. Cl.

CPC ..... *H01R 24/52* (2013.01); *H01Q 1/088* (2013.01); *H01Q 1/36* (2013.01); *H01Q 1/48* (2013.01); *H01Q 21/0025* (2013.01); *H01R 13/6278* (2013.01); *H01R 2201/02* (2013.01)

(58) Field of Classification Search

CPC ..... H01Q 1/088; H01Q 1/48; H01Q 21/0025; H01Q 21/205; H01Q 21/26

See application file for complete search history.

(56) References Cited

U.S. PATENT DOCUMENTS 7,106,268 B1 * 9/2006 Angelucci ..... H01Q 13/08 343/770

OTHER PUBLICATIONS

Carta et al., "Implementation of the ubiquitous radar concept with a conformal array," in 2015 European Radar Conference (EuRAD), Sep. 2015, 4 pages.

Fulton et al., "Cylindrical polarimetric phased array radar: Beamfomning and calibration for weather applications," IEEE Transactions on Geoscience and Remote Sensing, vol. 55, No. 5, May 2017, 15 pages.

(Continued)

*Primary Examiner* — Hoang V Nguyen

(74) *Attorney, Agent, or Firm* — US Naval Research Laboratory; Hong-Vinh Nguyen

(57) ABSTRACT

A novel, interlocking, snap-fit connection between an antenna aperture and a ground plane layer that contains coaxial connectors is described herein. The snap-fit design provides a simple and solderless transition from the connectors to elements of the antenna aperture. This design facilitates easy assembly and disassembly, allowing parts to be removed, reinstalled and/or reused.

14 Claims, 4 Drawing Sheets

(56) References Cited

OTHER PUBLICATIONS

Zhang et al., "5g millimeter-wave antenna array: Design and challenges," IEEE Wireless Communications, vol. 24, No. 2, Apr. 2017, 2 pages.
Hoyack et al., "Connector design for 3d printed antennas," in 2016 IEEE International Symposium on Antennas and Propagation (APSURSI), Jun. 2016, 2 pages.
Cooley et al., "Planar-fed folded notch (PFFN) arrays: A novel wideband technology for multi-function active electronically scanning arrays (AESAs)," IEEE Int. Symp. on Phased Array Systems and Tech., 2016, 6 pages.
Cung et al., "Enabling broadband, highly integrated phased array radiating elements through additive manufacturing," in IEEE Int. Symp. on Phased Array Systems and Tech., Oct. 2016, 9 pages.
Brigham et al., "Ultrawideband step notch array using stripline feed," in IEEE International Symp. on Antennas and Propag., Jun. 2007, 4 pages.
Kindt et al., "Ultrawideband all-metal flared-notch array radiator," IEEE Transactions on Antennas and Propagation, vol. 58, No. 11, Nov. 2010, 8 pages.

* cited by examiner

MODULAR SOLDERLESS CONNECTOR INTEGRATION FOR CONFORMAL PHASED ARRAYS

CROSS-REFERENCE TO RELATED APPLICATIONS

This Application claims the benefit of U.S. Provisional Application No. 62/845,008 filed on May 8, 2019, the entirety of which is incorporated herein by reference.

FEDERALLY-SPONSORED RESEARCH AND DEVELOPMENT

The United States Government has ownership rights in this invention. Licensing inquiries may be directed to Office of Technology Transfer, US Naval Research Laboratory, Code 1004, Washington, DC 20375, USA; +1.202.767.7230; techtran@nrl.navy.mil, referencing Navy Case #111111-US2.

BACKGROUND

Additive manufacturing (AM) is a low-cost, high-accuracy manufacturing technique suitable for building complex antenna apertures. However, a major challenge of this technique is integrating a transition from an antenna element to a coaxial connector. This challenge is caused by a number of factors. For example, the structure of an additively manufactured device may be brittle and not as rugged as a machined metal antenna array structure. Thus, such device may not be able to accommodate conventional connectors designed for the machined metal antenna array structure. Moreover, the additively manufactured device is typically plated with a thin metal finish that may be easily damaged and cannot withstand soldering. These factors significantly complicate the integration of a connector to the additively manufactured device.

A conventional method of connector integration for an antenna aperture made by AM includes using conductive epoxy and zip ties to connect a radio frequency (RF) cable to an element of that aperture where solder cannot be used. Another method uses integrated printed circuit boards (PCBs) to integrate whole feed networks while providing a more suitable surface on which to solder a connector. However, these methods suffer from poor and/or unstable connections, high cost or high complexity.

Connectors are also a significant cost-driver in the development of antenna apertures. Yet, in most cases, connector integration is a permanent process that does not allow connectors and/or their associated components to be removed and/or reused.

SUMMARY

Methods, systems and apparatuses are described herein that provide a novel, interlocking, snap-fit connection between an antenna aperture and a ground plane layer that contains coaxial connectors. The snap-fit design provides a simple and solderless transition from the connectors to the elements of the antenna aperture. This design facilitates easy assembly and disassembly, thereby allowing parts to be removed, reinstalled and/or reused.

In one embodiment, a modular solderless connector integration system for a conformal array is described. The system includes an opening formed on a ground plane; a flexible hook formed on the array, the array having a same geometrical shape as the ground plane layer, the hook being configured to be deflected to allow it to mate with the opening; and a transition assembly configured to transition an element of the array to a connector.

Optionally, the hook is configured to be deflected for insertion through the opening and be undeflected to securely attach the array to the ground plane layer.

Optionally, the hook enables of the array to be detached from the ground plane layer.

Optionally, the transition assembly comprises a conductive tube and a conductive element encased in a dielectric material.

Optionally, the transition assembly is integrated in at least one of the array or the ground plane layer.

Optionally, the connector is integrated in the ground plane layer.

Optionally, the conformal phased array is at least one of a planar phased array, a circular phased array, or a cylindrical phased array.

In another embodiment, a method of modular solderless connector integration for a conformal phased array is described. The method includes providing an opening on a ground plane layer; forming a flexible hook on the array, the array having a same geometrical shape as the ground plane layer, the hook being configured to be deflected to allow it to mate with the opening; and forming a transition assembly configured to transition an element of the array to a connector.

Optionally, the method includes integrating the transition assembly with the element, the transition assembly comprising a conductive tube and a conductive element encased in a dielectric material.

Optionally, the method includes integrating the connector with the ground plane layer.

Optionally, the method includes attaching the array to the ground plane layer via the hook.

Optionally, the method includes detaching the array from the ground plane layer via the hook.

Further features and advantages of the invention, as well as the structure and operation of various embodiments are described in detail below with reference to the accompanying drawings.

DETAILED DESCRIPTION

Definitions

References in the specification to "one embodiment," "an embodiment," "an example embodiment," etc., indicate that the embodiment described may include a particular feature, structure, or characteristic, but every embodiment may not necessarily include the particular feature, structure, or characteristic. Moreover, such phrases are not necessarily referring to the same embodiment. Further, when a feature, structure, or characteristic is described in connection with an embodiment, it is submitted that it is within the knowledge of one skilled in the art to effect such feature, structure, or characteristic in connection with other embodiments whether or not explicitly described.

In describing and claiming the disclosed embodiments, the following terminology will be used in accordance with the definition set forth below.

As used herein, the singular forms "a," "an," "the," and "said" do not preclude plural referents, unless the content clearly dictates otherwise.

As used herein, the term "and/or" includes any and all combinations of one or more of the associated listed items.

As used herein, the term "about" or "approximately" when used in conjunction with a stated numerical value or range denotes somewhat more or somewhat less than the stated value or range, to within a range of ±10% of that stated.

Overview

The radiation pattern reconfigurability offered cylindrical arrays makes them an attractive aperture for applications including ubiquitous radar, weather radar, and 5G millimeter wave communications systems. However, as with any conformal structure, manufacturing of cylindrical arrays comes with challenges not seen in traditional linear or planar apertures.

In embodiments, a system and method for modular solderless connector integration is described. This technique provides a simple, solderless transition from connectors to antenna elements of a conformal phased array by using flexible, interlocking hooks to securely fasten the array to a ground plane in a snap-fit manner. This snap-fit technique facilitates an easy assembly and disassembly process, allowing parts to be removed, reinstalled and/or reused (e.g., with other apertures of the same lattice spacing) to reduce costs. In addition, electrical continuity and tight tolerances are maintained over potentially long, thin excitation ports (holes) in an array that is 3D-printed. This technique eliminates concerns over stripping and/or damaging electroplating.

EXAMPLES

Figure 1:
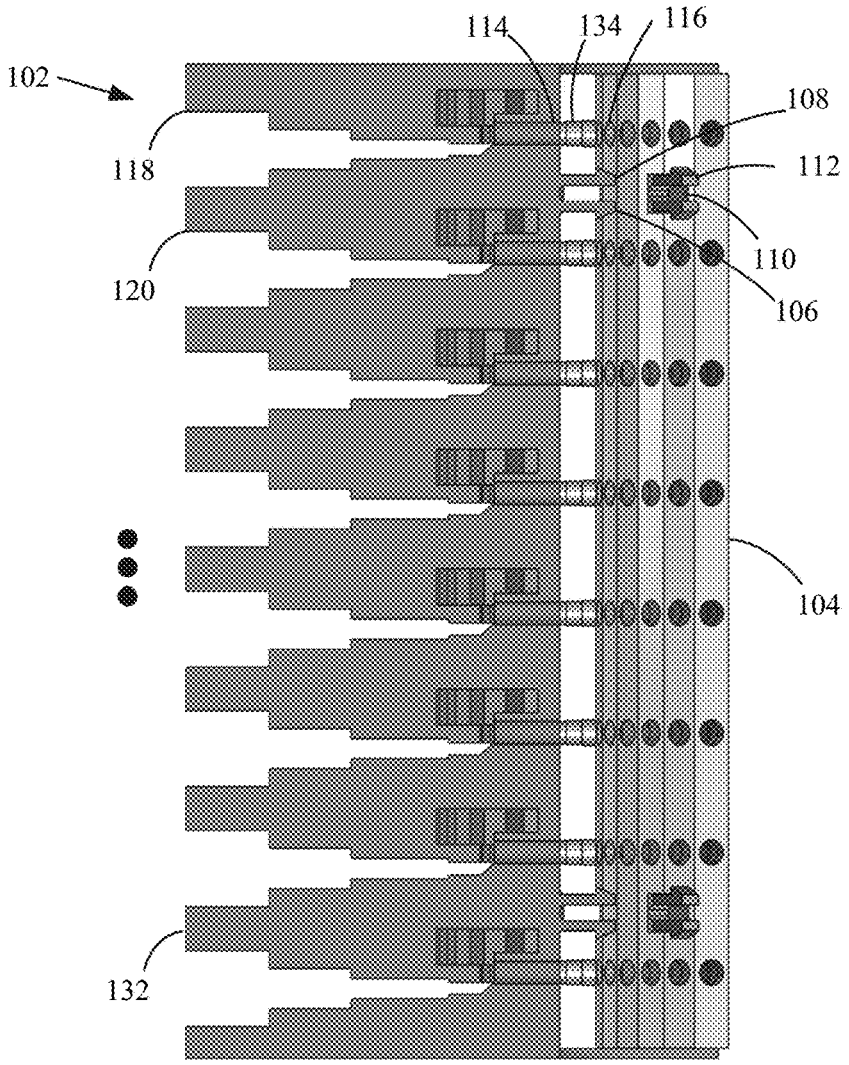
FIG. 1 depicts an exemplary conformal phased array in a side view.

FIG. 1 shows an exemplary conformal phased array 102 in a side view. Array 102 may be a phased array antenna formed of many identical small, flat antenna elements 120-132 shown in FIG. 1. Elements 118-132 may cover the surface of array 102 and the number of elements 118-132 may vary depending on the application. In an embodiment, elements 118-132 are step-notch elements, but the invention is not limited to this type elements. Array 102 may conform to any shape, for example, linear, planar, circular or cylindrical. Thus, array 102 may be a planar phased array, a circular phased array, or a cylindrical phased array.

Also shown in FIG. 1 is ground plane 104. Ground plane 104 is a metal layer and may be machined from a piece of metal or otherwise formed from a metal. In an embodiment, the ground plane is machined from aluminum to allow for high-accuracy placement of connectors. Ground plane 104 may include a first set of openings that includes opening 110 and a second set of openings that includes opening 116.

Array 102 may include flexible hooks 106 and 108 formed as protrusions on the back of array 102. Hooks 106 and 108 are designed to correspond to opening 110 of ground plane 104. Array 102 and ground plane 104 may have the same geometrical shape to allow array 102 to be securely attached to ground plane 104 via hooks 106 and 108. Alternatively, array 102 and ground plane 104 may be composed of one or more sections that have congruent geometrical shapes to enable the one or more sections of array 102 to be securely attached to the corresponding one or more sections of ground plane 104 via hooks 106 and 108. For example, hooks 106 and 108 may be deflected to allow them to mate with corresponding opening 110 on ground plane 104. Thus, during the assembly process, hooks 106 and 108 may be deflected slightly to pass through opening 110, and then be undeflected to their original shape (shown as 112 in FIG. 1) to enable array 102 and ground plane 104 to be adjoined tightly together. This is a reversible process, allowing ground plane 104 and array 102 to be detached from one another via hooks 106 and 108. The removal process includes compressing hooks 106 and 108 to allow them to pass back through opening 110. Thus ground plane 104 may be removed, reinstalled and/or reused on similarly shaped array apertures that have the same inter-element spacing as array 102. While it is beneficial for this snap-fit technique to be a reversible process, in certain applications, it may be desirable to have this process to be non-reversible. Thus, in an embodiment, hooks 106 and 108 may be designed to enable a permanent snap-fit (e.g., without a lever).

Hooks 106 and 108 may be formed from any suitable material with enough flexibility to enable them to be snap-fit attachment features. Such material may include any material suitable for the manufacturing process (e.g., AM) and may be deflected. In an embodiment, array 102, including hooks 106 and 108 may be additively manufactured using powdered nylon and then electroplated with a metal (e.g., copper) to provide conductivity. Hooks 106 and 108 may take on any form, such as cantilever, torsional and annular. Hooks 106 and 108 may serve as alternatives to screws and provide ease of assembly and no loose parts as they are integrally formed on array 102. While four cantilevered hooks are shown in FIG. 1, any number of hooks may be formed on array 102 to ensure strong attachment and good electrical contact between elements 120-132 and the coaxial cable(s) (not shown in FIG. 1).

A transition assembly 114 configured to transition an element of array 102, such as element 118 to a connector 134 is further shown in FIG. 1. In an embodiment, there may be one transition assembly for each antenna element. Each transition assembly may correspond to and/or connected with a connector, which may correspond to an opening (e.g., opening 116) in the second set of openings on ground plane 104. Transition assembly 114 ensures conductivity between connector 134 and array 102. Transition assembly 114 may be integrated in array 102 as shown in FIG. 1 or on ground plane 104. Connector 134 may be any suitable connector, for example, a screw-on connector, a press-fit connector (e.g., commercially-available SMPM), etc. Depending on its type, the connector may be integrated into ground plane 104 or formed as an extension of transition assembly 114 and/or integrated into array 102.

In an embodiment, array 102 may be additively manufactured as a single structure. In another embodiment, array 102 may be manufactured in modular sections that may be assembled together to form the complete array. The snap-fit technique is not limited to devices made by the AM process, although the snap-fit technique may be more applicable and/or beneficial to certain manufacturing methods and array designs than others.

Figure 2:
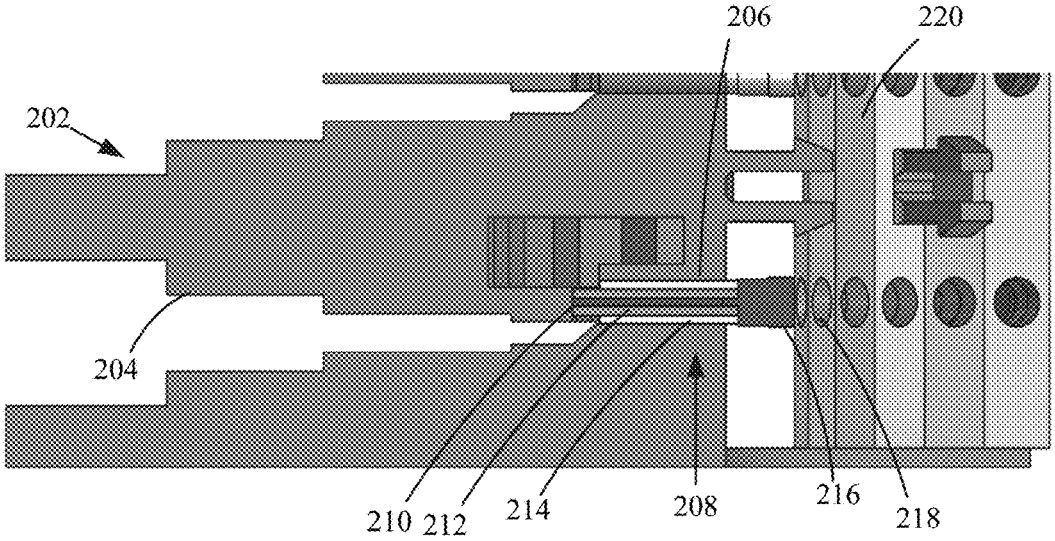
FIG. 2 depicts an exemplary conformal phased array with an element to coaxial cable transition in a side view.

FIG. 2 depicts an exemplary conformal phased array 202 with an element to coaxial cable transition in a side view. Array 202 has features that are similar to array 102, thus those features may not be described in detail again. Array 202 includes a step-notch element 204, which includes an excitation port 206, an opening that is configured to accommodate transition assembly 208. Transition assembly 208 may include a thin conducting tube 214, which is designed to maintain tight tolerances and conductivity over a potentially long, narrow tube, which may be a difficult task for AM. Transition assembly 208 may further include a dielectric tube 212 (e.g., Teflon®) sized to provide a 500 impedance. The inner diameter of dielectric tube 212 may support a conductive element 210 (e.g., a copper Fuzz Button®) that may be compressed between the conducting edge of element 204 and a center conductor of connector 216.

Figure 3:
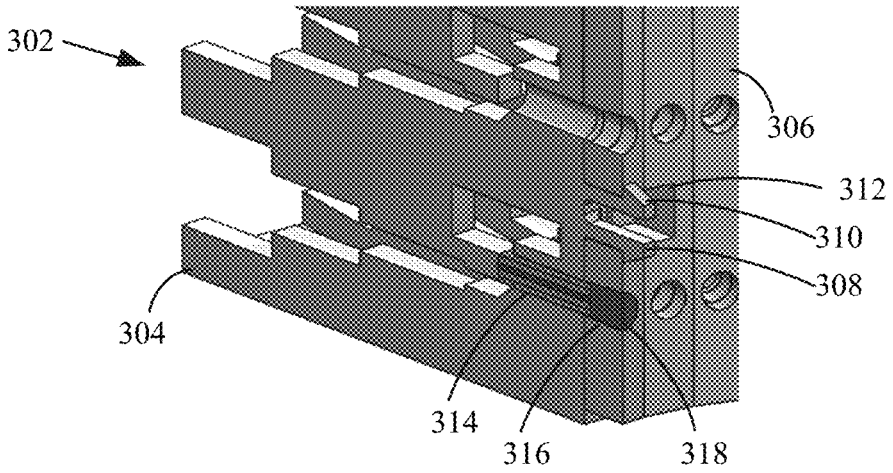
FIG. 3 depicts an exemplary conformal phased array securely attached to a ground plane in a sectional view.

FIG. 3 depicts an exemplary conformal phased array 302 securely attached to a ground plane 306 in a sectional view. Array 302 include features that may be similar and/or the same as features found in array 102 and 202 and thus these features are not described again for the sake of brevity. As shown in FIG. 3, array 302 is tightly adjoined with ground plane 306 by virtue of hooks 308 and 310 being engaged in opening 312 in their uncompressed state. Moreover, transition assembly 314, being housed in array 302, forms an electrical contact with the conducting edge of element 304 on one end and forms an electrical contact with connector 316, which housed in opening 318 of ground plane 306.

Figure 4:
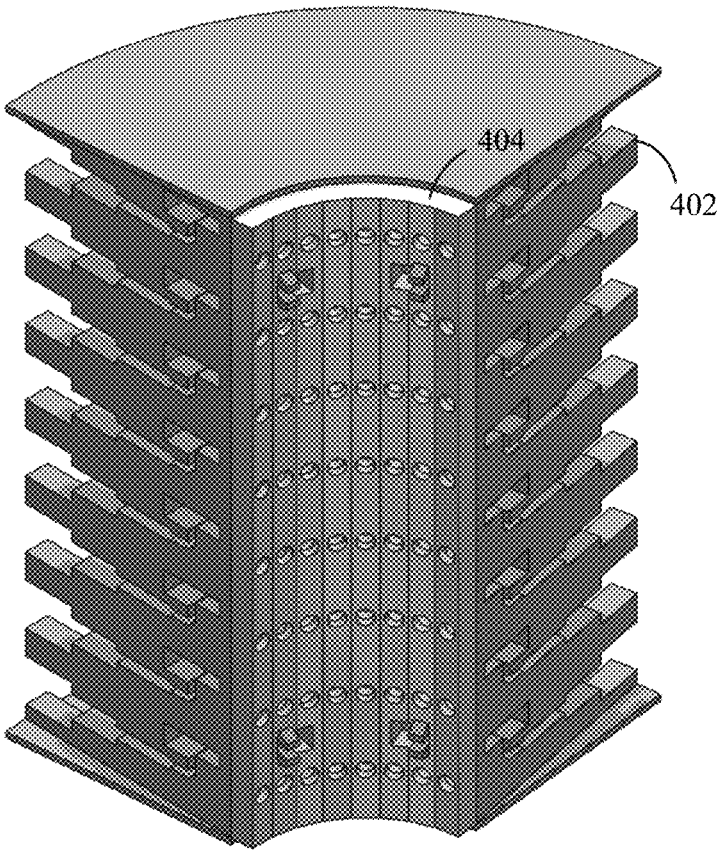
FIG. 4 depicts an exemplary cylindrical array section securely attached to a ground plane in a sectional view.

FIG. 4 depicts an exemplary cylindrical array 402, specifically a 90° sector of a cylindrical array being securely attached to a ground plane 404 in a sectional view. As shown in FIG. 4, there are four sets of hooks formed on array 402, two closer to the bottom of the cylinder and two closer to the top for ease of assembly (e.g., to enable the hooks to be more accessible by hand when the entire cylindrical array is assembled together). These hooks sets are mated with four corresponding openings on ground plane 404. The number and placement of the openings and hooks are for illustrative purposes only and are not intended to be limiting. There may be more or fewer of these features as desired for a particular antenna design, shape, size, etc. As shown in FIG. 4, array 402 has a curvilinear back. Therefore, ground plane 404 also has the same/similar curvilinear shape in order for the two components to be mated and securely attached to one another for physical fit as well as for electrical conductivity purposes. In an embodiment, array 402 is designed to operate in the range of 2-10 GHz. Accordingly, array 402 has an outer radius of 6 inches and a height of 4.8 inches. The elements of array 402 are spaced at $\lambda/2$ at 10 GHz, the top operating frequency, both vertically and circumferentially. In other embodiments, the elements may be spaced based on the wavelength of a frequency in the operational range, but not necessarily at exactly $\lambda/2$. The sampling in azimuth minimizes the impact of distortion modes while the vertical spacing enables wide-angle scanning in elevation.

Figure 5:
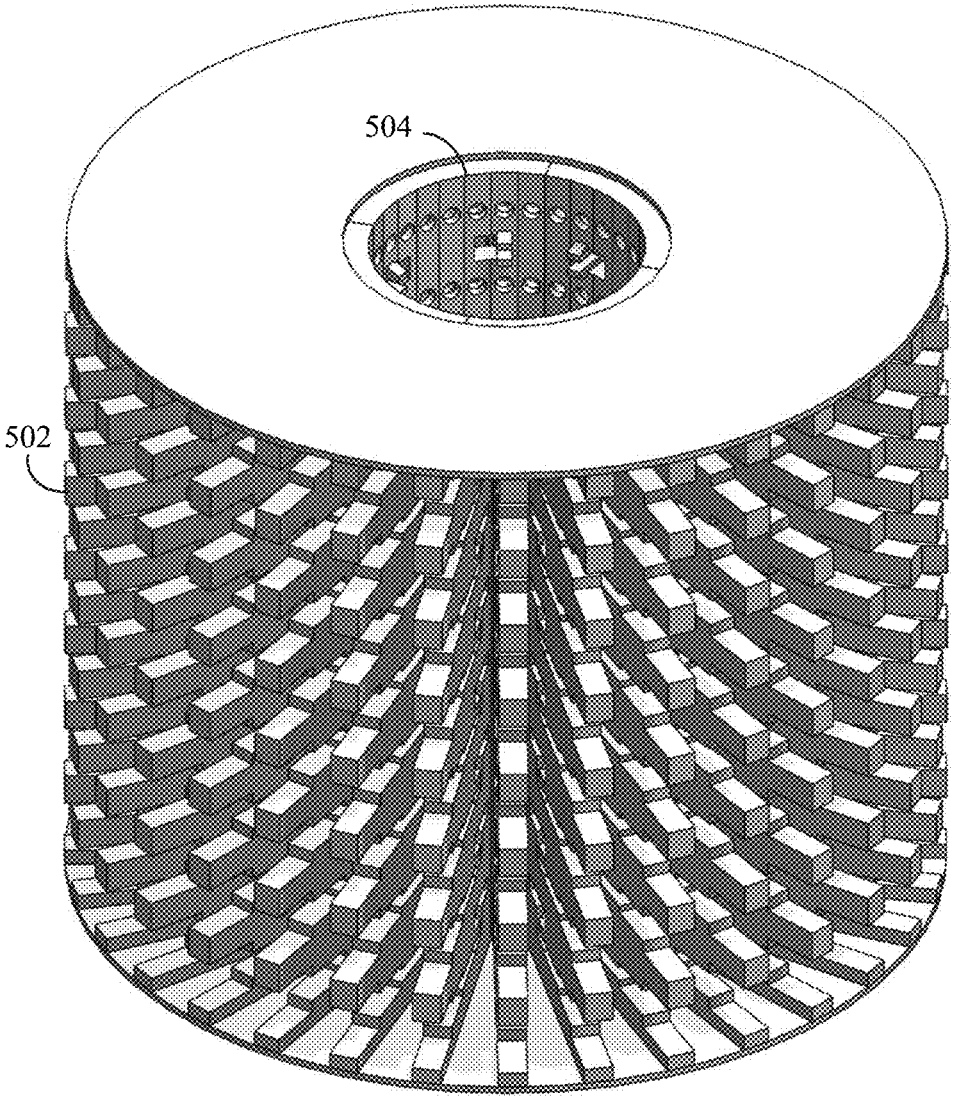
FIG. 5 depicts an exemplary cylindrical array securely attached to a ground plane in a perspective view.

FIG. 5 depicts an exemplary cylindrical array 502 securely attached to a ground plane 504 in a perspective view. For example, cylindrical array 502 may be formed from four sectors depicted in FIG. 4. As shown in FIG. 5, there are three sets of cantilevered hooks formed on the back of array 502 and protruding from the inner radius of array 502. As can be seen in FIG. 5, three sets of hooks are protruding through corresponding openings on ground plane 504. While not shown in FIG. 5, more hooks and corresponding openings may be utilized.

Figure 6:
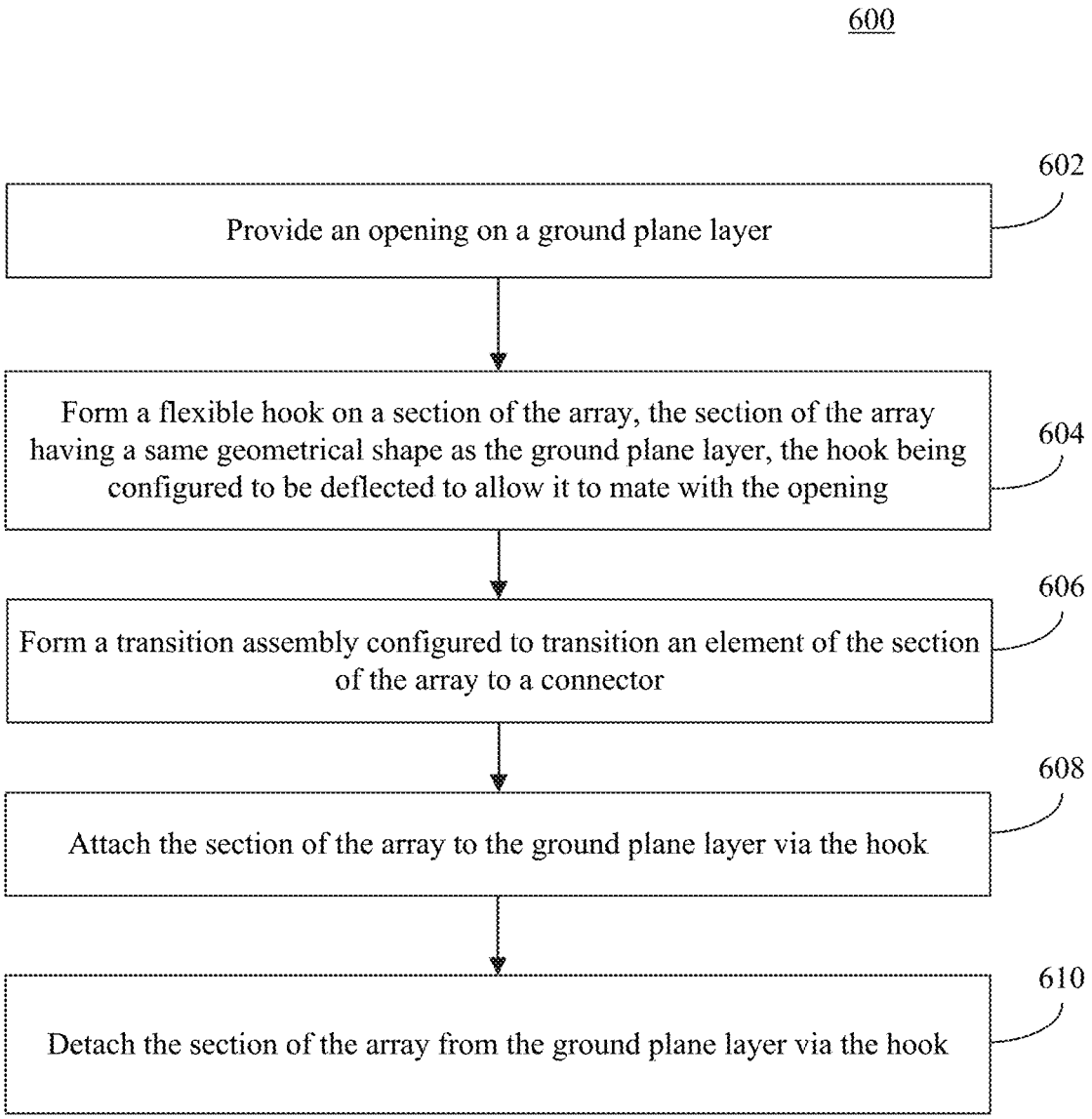
FIG. 6 depicts a flowchart providing an exemplary process for modular solderless connector integration for a conformal phased array.

FIG. 6 depicts a flowchart 600 providing an exemplary process for modular solderless connector integration for a conformal phased array. Flowchart 600 begins with step 602. In step 602, an opening on a ground plane layer is provided. For example, as described above with reference to FIG. 1, the openings on ground plane 104 may be formed by any suitable cutting tool, for example, milling machines, drill or tapping devices.

In step 604, a flexible hook is provided on the array, the array having a same geometrical shape as the ground plane layer, the hook being configured to be deflected to allow it to mate with the opening. For example and in reference to FIG. 1, one or more hooks may be formed on the back of array 102. The hook may have any suitable shape and/or size, such as annular, cantilever or torsional. The hook may be formed from a plastic material, such as powdered nylon. The hook may also be electroplated with a thin layer of metal to provide conductivity.

In step 606, a transition assembly configured to transition an element of the array to a connector is formed. As described above, transition assembly 114 of FIG. 1 may be integrated into array 102 and ensures conductivity between connector 134 and array 102. As shown in FIG. 2, the transition assembly may include conducting tube 214, dielectric tube 212 and conductive element 210. In an embodiment, during the assembly process, conductive tube 214 may be inserted into an excitation port of an element of an array. The conductive element may be encased in the dielectric tube and fill the conductive tube. The connector may be placed into machined holes on the ground plane.

In step 608, the array is attached to the ground plane layer via the hook. For example, as shown in FIGS. 3, 4, and 5, the array is attached to the ground plane layer via one or more flexible hooks. The transition assemblies are lined up with the connectors and/or openings on the ground plane, thereby compressing the conductive elements ensuring contact between the conductive edges of the elements and the pins of the connectors. Then the hooks are compressed, allowing them to pass through the corresponding openings on the ground plane. Once through, the force is removed such that the hooks are no longer compressed to allow the hooks to resume their natural state, securely attaching the array to the ground plane.

In step 610, the array is detached from the ground plane layer via the hook. For example and in referenced to FIG. 2, ground plane 306 may be removed from array 302 via hooks 308 and 310. For example, hooks 308 and 310 may be compressed, allowing them to be passed through the openings on ground plane 306. In this manner, parts such as ground plane layers and connectors may be removed, reinstalled and/or reused with other suitable parts (e.g., of similar or the same shapes, sizes, lattice spacing).

The example embodiments described herein are provided for illustrative purposes and are not limiting. The examples described herein may be adapted to any type of targeted crawling system. Further structural and operational embodiments, including modifications/alterations, will become apparent to persons skilled in the relevant art(s) from the teachings herein.

CONCLUSION

While various embodiments of the disclosed subject matter have been described above, it should be understood that they have been presented by way of example only, and not limitation. Various modifications and variations are possible without departing from the spirit and scope of the embodiments as defined in the appended claims. Accordingly, the breadth and scope of the disclosed subject matter should not be limited by any of the above-described exemplary embodiments, but should be defined only in accordance with the following claims and their equivalents.

What is claimed is:

1. A modular solderless connector integration system for a conformal array, comprising:

an opening formed on a ground plane layer, the ground plane layer having a same geometrical shape as the conformal array;

a flexible hook formed on the array, the hook being configured to be deflected to allow it to mate with the opening in a reversible process; and a transition assembly configured to transition an element of the array to a connector.

2. The modular solderless connector integration system of claim 1, wherein the hook is configured to be deflected for insertion through the opening and be undeflected to securely attach the array to the ground plane layer.

3. The modular solderless connector integration system of claim 2, wherein the hook enables of the array to be detached from the ground plane layer.

4. The modular solderless connector integration system of claim 1, wherein the transition assembly comprises a conductive tube and a conductive element encased in a dielectric material.

5. The modular solderless connector integration system of claim 1, wherein the transition assembly is integrated in at least one of the array or the ground plane layer.

6. The modular solderless connector integration system of claim 1, wherein the connector is integrated in the ground plane layer.

7. The modular solderless connector integration system of claim 1, wherein the conformal phased array is at least one of a planar phased array, a circular phased array, or a cylindrical phased array.

8. The modular solderless connector integration system of claim 1, wherein the connector is formed separate from the array and is configured to be integrated into the array in a solderless, removable manner.

9. A method of modular solderless connector integration for a conformal phased array, comprising:

providing an opening on a ground plane layer, the ground plane layer having a same geometrical shape as the conformal array;

forming a flexible hook on the array, the hook being configured to be deflected to allow it to mate with the opening in a reversible process; and forming a transition assembly configured to transition an element of the array to a connector.

10. The method of claim 9, further comprising:

integrating the transition assembly with the element, the transition assembly comprising a conductive tube and a conductive element encased in a dielectric material.

11. The method of claim 9, further comprising:

integrating the connector with the ground plane layer.

12. The method of claim 9, further comprising:

attaching the array to the ground plane layer via the hook.

13. The method of claim 12, further comprising:

detaching the array from the ground plane layer via the hook.

14. The method of claim 9, further comprising:

forming the connector separate from the array, the connector being configured to be integrated into the array in a solderless, removable manner.

* * * * *